US006306274B1

(12) United States Patent
Kajiyama

(10) Patent No.: US 6,306,274 B1
(45) Date of Patent: Oct. 23, 2001

(54) METHOD FOR MAKING ELECTRODEPOSITION BLADES

(75) Inventor: Keiichi Kajiyama, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 09/392,458

(22) Filed: Sep. 9, 1999

(30) Foreign Application Priority Data

Sep. 17, 1998 (JP) ..... 10-262865

(51) Int. Cl.[7] ..... C25D 1/00; C25D 15/00

(52) U.S. Cl. ..... 205/67; 205/110; 205/206; 205/208; 205/210

(58) Field of Search ..... 205/110, 221, 205/661, 111, 112, 109, 208, 210, 67, 73, 206

(56) References Cited

U.S. PATENT DOCUMENTS 3,691,707 * 9/1972 Von Arx et al. ..... 51/206
4,079,552 * 3/1978 Fletcher ..... 51/295
5,545,439 * 8/1996 Deng et al. ..... 427/327

FOREIGN PATENT DOCUMENTS 49-14613 * 4/1974 (JP) ..... 205/110
871-843 * 10/1981 (SU) ..... 205/110

* cited by examiner

*Primary Examiner*—Kathryn Gorgos
*Assistant Examiner*—William T. Leader
(74) *Attorney, Agent, or Firm*—Arent Fox Kintner Plotkin & Kahn, PLLC

(57) ABSTRACT

Disclosed are an apparatus and method for making both coarse-sided electrodeposition blades for cutting, for instance, semiconductor wafers. The apparatus comprises at least an electrolyte bath containing an electrodeposition object and pulverized grindstone in the electrolyte, an electrolytic metal immersed in the electrolyte, and an electric source whose positive and negative terminals are connected to the electrolytic metal and electrodeposition object, and the surface of the electrodeposition object, on which a required electro-deposit is to be formed, is of a predetermined coarseness. The method comprises at least the steps of: forming minute irregularities on the surface of the electrodeposition object, on which a required electro-deposit is to be formed, thus providing a predetermined coarseness on the electrodeposition object; immersing the electrodeposition object in the electrolyte to grow an electro-deposit on the surface of the electrodeposition object by making electric current to flow in the electrolyte; and taking the electrodeposition object having the electro-deposit formed on its surface away from the electrolyte bath to remove a selected part or the whole of the electrodeposition object, thus leaving the electro-deposit.

5 Claims, 8 Drawing Sheets

METHOD FOR MAKING ELECTRODEPOSITION BLADES

BACKGROUND OF THE INVENTION

1. Field of the Invention

The present invention relates to the apparatus and method for making electrodeposition blades, and more particularly electrodeposition blades each having same coarseness on its opposite sides.

2. Related Arts

Referring to FIG. 7, cutting means 33 having an electrodeposition blade attached thereto is used in a semiconductor wafer dicing apparatus 30. In dicing a semiconductor wafer W it is 16 attached to a carrier F by means of an adhesive tape T, and the carrier F is sucked on the chuck table 31. Then, the chuck table 31 is moved in an X-direction to be put below the alignment means 32 of the dicing apparatus 30 for detecting the dicing area in the semiconductor wafer W. Then, the chuck table 31 is moved in the X-direction, thereby allowing the cutting means 33 to cut the semiconductor wafer W.

Referring to FIG. 8, the cutting means 33 comprises a spindle unit 35 having an electrodeposition blade 34 attached thereto, a blade monitor 36 for detecting cracks breaking, if any in the blade and a coolant supply 37 for supplying the blade with cooling water.

Referring to FIG. 9, the spindle unit 35 includes a spindle 39 rotatably supported in its housing 38, and a mount flange 40 which is fastened to the tip of the spindle 39 with an associated nut 44. A washer-like electrodeposition blade 41 is sandwiched between the mount flange 40 and the counter flange 42 to be fastened with a blade locking nut 43.

A semiconductor wafer W can be cut with the electrodeposition blade 41 when the spindle 39 is rotated. FIG. 10 shows a similar spindle unit 35 having a hub-like electrodeposition blade 45 attached thereto.

Washer-like electrodeposition blades such as shown in FIG. 9 can be made by an apparatus for making electrodeposition blades as shown in FIG. 11. As shown, an electrolytic cell 15 contains an electrolyte 11 such as nickel sulfate in which pulverized grindstone such as pulverized diamond is suspended. In the electrolyte bath an electrodeposition object 51 and an electrolytic metal 17 such as nickel are immersed, and the electrodeposition object 51 is connected to the minus terminal of an electric source 16 whereas the electrolytic metal 17 is connected to the plus terminal of the electric source 16.

In making a washer-like electrodeposition blade a ring-like object 51 is used as shown in FIG. 12. It is made of aluminum, and its inner and outer circumferences 52 and 53 are covered with masking material, thus leaving its flat annular surfaces 54 to be exposed.

When a predetermined voltage is applied between the electrolytic plate 17 and the electrodeposition object 51, pulverized diamond 12 and ionized metal particles are deposited on the exposed surfaces 54 of the electrodeposition object 51, thus allowing an electro-deposit 55 of pulverized diamond 12 and metal particles to grow thereon.

When the composite layer 55 has reached a desired thickness, the electrodeposition object 13 having the composite layer 55 formed on its surface 54 is taken out from the electrolyte bath 11, and then, the composite layer 55 is removed from the electrodeposition object 51. Thus, the washer-like electrodeposition blade 41 (FIG. 9) results.

As seen from the enlarged fragment view of FIG. 11, the surface 54 of the electrodeposition object 51 on which an electo-deposit is formed is flat, and therefore, the resultant electrodeposition blade 41 has a flat surface formed on one side, on which electrodeposition was started, as indicated by dot-and-dash lines in FIG. 13. In contrast, particles of pulverized grindstone 12 project significantly on the other surface 57 of the electrodeposition blade 41, on which electrodeposition was finished. When a selected workpiece is cut with such electrodeposition blade whose opposite surfaces have different degrees of coarseness, one surface of the workpiece on which it was cut with the less-coarse surface of the electrodeposition blade is different significantly in appearance or physical characteristics from the other surface on which the workpiece was cut with the coarse surface of the electrodeposition blade.

In order to make the deposition-starting surface 56 as coarse as the deposition-finishing surface 57 of the electrodeposition blade it is necessary to effect another electrodeposition on the deposition-starting surface 56 of the resultant electrodeposition blade or to effect etching on the deposition-starting surface 56 to the depth as indicated by dot-and-dash lines 58, thereby exposing as much particulate projections as on the other surface 57. Disadvantageously such extra processing lowers the efficiency with which electrodeposition blades can be made.

There has been, therefore, an increasing demand for facilitating the producing of both coarse-sided electrodeposition blades.

SUMMARY OF THE INVENTION

One object of the present invention is to provide an apparatus for making both coarse-sided electrodeposition blades efficiently.

An apparatus for making an electrodeposition blade comprising at least an electrolyte bath containing an electrodeposition object and pulverized grindstone, an electrolytic metal immersed in the electrolyte bath, and an electric source whose positive and negative terminals are connected to the electrolytic metal and electrodeposition object respectively, is improved according to the present invention in that the surface of the electrodeposition object, on which a required electro-deposit is to be formed, is of a predetermined coarseness, which is provided by forming minute irregularities thereon.

The irregularities of the predetermined coarseness may be shorter than the particle size of pulverized grindstone in terms of the valley-to-peak height.

The irregularities of the predetermined coarseness may be 10 to 80% of the particle size of pulverized grindstone in terms of the valley-to-peak height.

The particle size of pulverized grindstone may be equal to 10 or less $\mu$m.

Another object of the present invention is to provide a method for making both coarse-sided electrodeposition blades efficiently A method for making an electrodeposition blade using an apparatus for making an electrodeposition blade comprising at least an electrolyte bath containing an electrodeposition object and pulverized grindstone, an electrolytic metal immersed in the electrolyte bath, and an electric source whose positive and negative terminals are connected to the electrolytic metal and the electrodeposition object respectively, is improved according to the present invention in that said method comprises at least the steps of: forming minute irregularities on the surface of the electrodeposition object, on which a required electro-deposit is to be formed, thereby providing a predetermined coarseness on the electrodeposition object; immersing the electrodeposition object in the electrolyte bath to grow an electro-deposit on the surface of the electrodeposition object by permitting electric current to flow in the electrolyte; and taking the electrodeposition object having an electro-deposit formed on its surface away from the electrolyte bath to remove a selected part or the whole of the electrodeposition object, thus leaving the electro-deposit.

The whole of the electrodeposition object may be removed to provide a washer-like electrodeposition blade in the form of electro-deposit.

A selected part of the electrodeposition object may be removed to provide a hub-like electrodeposition blade in the form of electro-deposit.

The step of forming minute irregularities on the surface of the electrodeposition object may include the step of: cutting or scratching the surface with the sharp tool of a lathe machine by feeding the tool a controlled radial distance and by cutting a controlled depth; sandblasting or chemical etching to provide a predetermined coarseness on the electrodeposition object.

The coarseness may be so determined that the valley-to-peak height of the irregularities may be below the particle size of pulverized grindstone.

The valley-to-peak height of the irregularities may be 10 to 80% of the particle size of pulverized grindstone.

The particle size of pulverized grindstone may be equal to 10 or less $\mu$m.

The method and apparatus according to the present invention permits the producing of both coarse-sided electrodeposition blades without requiring any extra processing such as additional electrodeposition or etching, and accordingly electrodeposition blades can be produced at an increased efficiency.

Other objects and advantages of the present invention will be understood from the following description of preferred embodiments of the present invention, which are illustrated in the accompanying drawings.

BRIEF DESCRIPTION OF THE DRAWING

FIG. 11 is similar to FIG. 1, but showing how the resultant electrodeposition blade is like;

DETAILED DESCRIPTION OF PREFERRED EMBODIMENT

Figure 1:
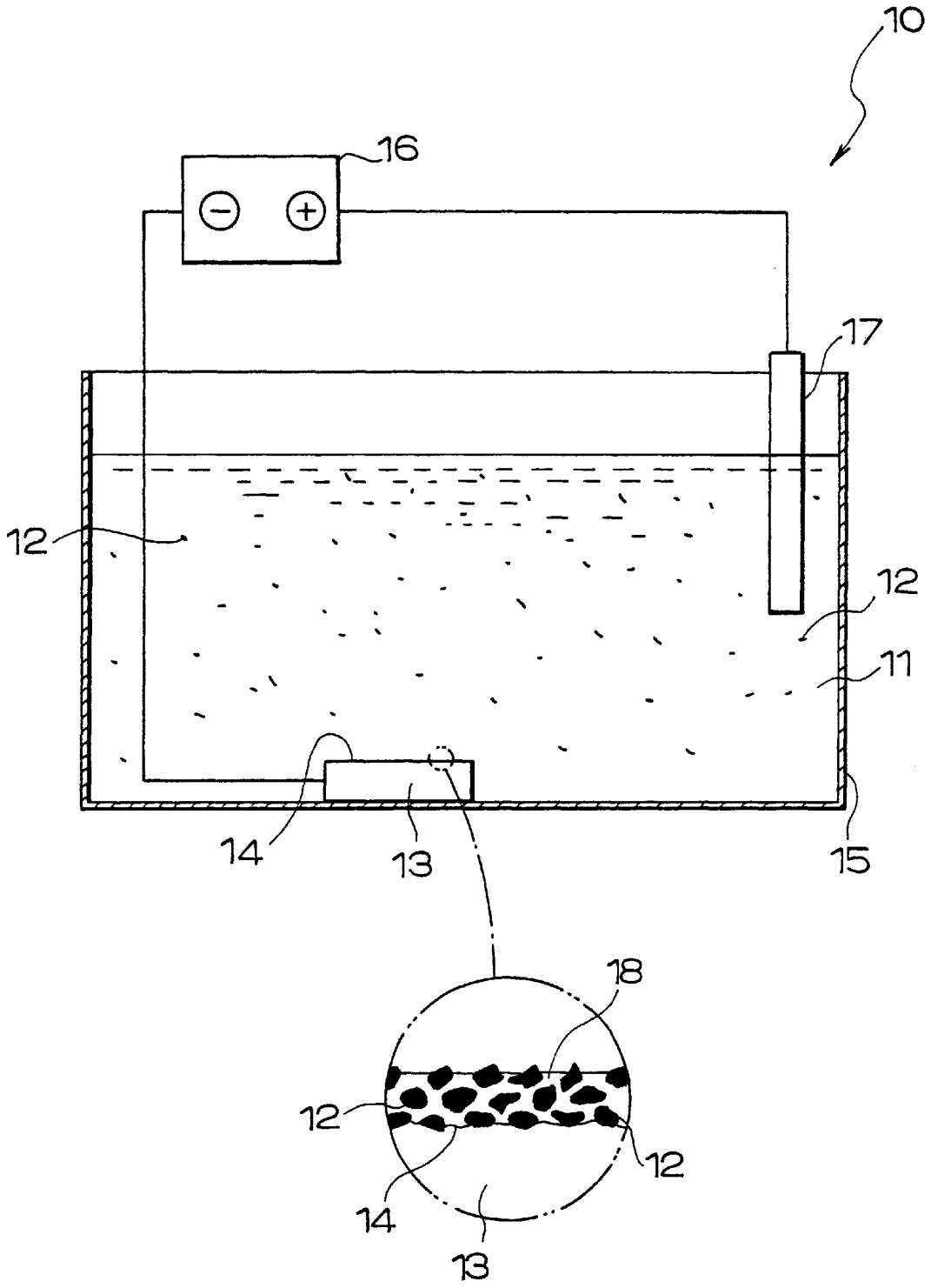
FIG. 1 illustrates an apparatus for making electrodeposition blades, which can be used in making both coarse-sided electrodeposition blades according to the present invention, showing how the resultant electrodeposition blade is like when made according to the present invention, also.

Referring to FIG. 1, an electrodeposition apparatus 10 has an electrolyte bath contained in its vessel. The electrolyte bath is composed of pulverized grindstone such as 10 or more micron-large particles of diamond 12 and an electrolyte 11.

Figure 2:
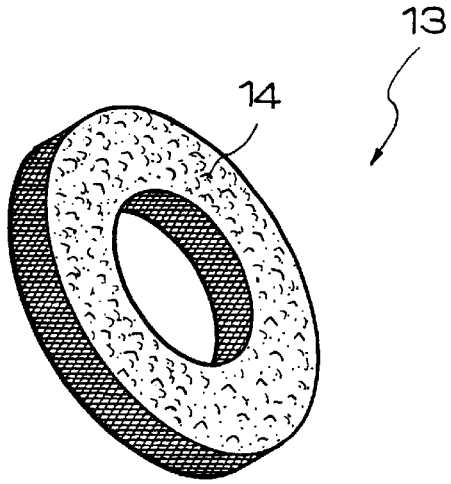
FIG. 2 is a perspective view of an electrodeposition object to be used in making a washer-like electrodeposition blade.
Figure 9:
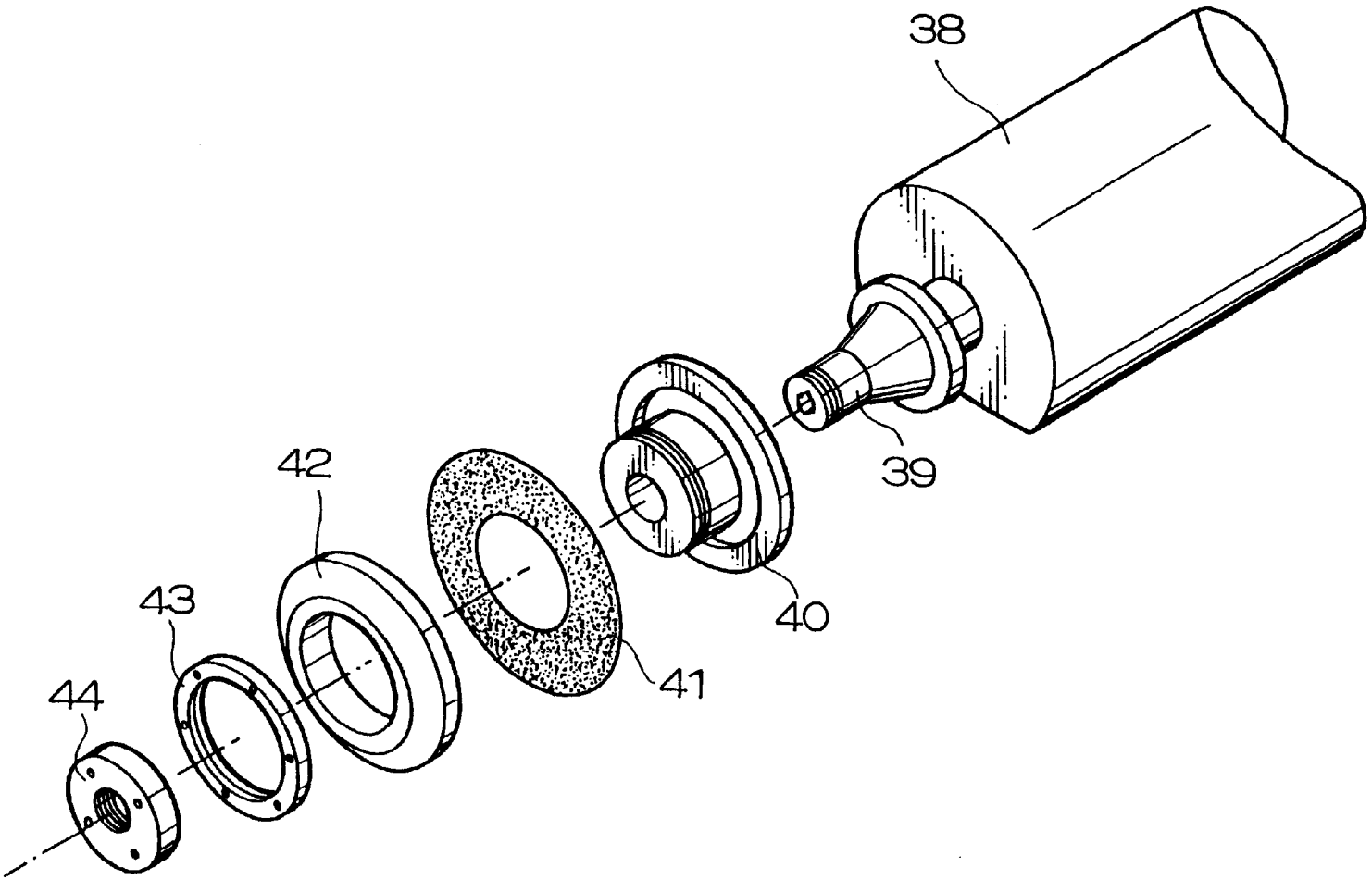
FIG. 9 is an exploded view of the spindle assembly of the cutting unit to which a washer-like electrodeposition blade is to be attached.

In making a washer-like electrodeposition blade such as shown in FIG. 9, a washer-like electrodeposition object of aluminum is exposed to sandblasting, chemical etching or mechanical scratching to form irregularities on its major surfaces 14 (see FIG. 2) prior to immersion in the electrolyte bath (the step of coarse-surface treatment). The scratching can be effected by means of a lathe, specifically by allowing its bite to scratch one major surface of the electrodeposition object with controlled radial feeding and cutting depth. The irregularities of the predetermined coarseness may be 10 to 80% of the particle size of pulverized grindstone in terms of the valley-to-peak height. The coarseness may be equal to 10 to 80% of the particle size of pulverized grindstone in terms of the valley-to-peak height.

The electrodeposition object 13 is put on the bottom of the electrolytic cell 15 with its coarse surface 14 up, and is connected to the minus terminal of the electric source 16. Also, an electrolytic metal 17 such as nickel is immersed in the electrolyte bath 11, and is connected to the plus terminal of the electric source 16.

When a predetermined voltage is applied between the electrodeposition object 13 and the electrolytic metal 17, an electro-deposit 18 which is composed of electrolytic metal molecules and pulverized diamond is allowed to be grown on the electrodeposition object 13 (the step of forming an electro-deposit).

The electrodeposition object 13 has irregularities formed on one surface, and these irregularities are shorter than the particle size of pulverized grindstone in their valley-to-peak height. Particles of pulverized grindstone 12, therefore, are arranged along the irregularities of the deposition surface of the electrodeposition object 13, thus causing the electro-deposit to have same coarseness on its opposite sides (the step of forming an electro-deposit).

Figure 3:
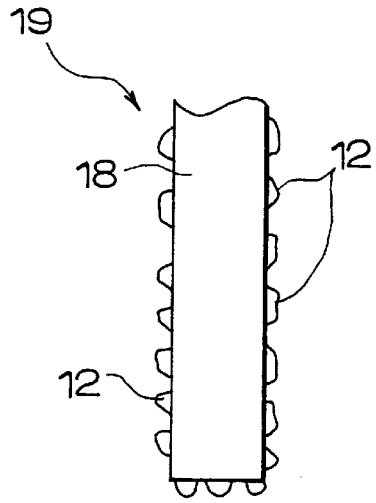
FIG. 3 is a side view of a fragment of the electrodeposition blade made according to the present invention.
Figure 4:
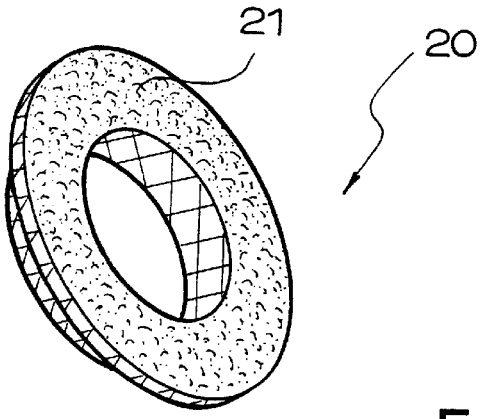
FIG. 4 is a perspective view of an electrodeposition object to be used in making a hub-like electrodeposition blade.
Figure 5:
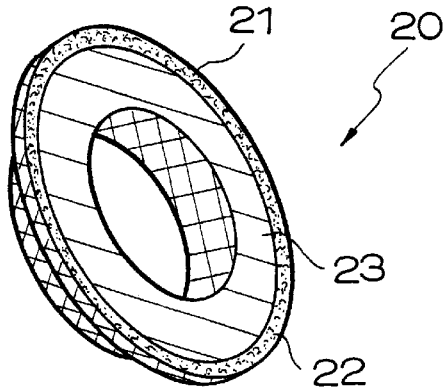
FIG. 5 is a perspective view of a hub-like electrodeposition object having its surface selectively masked.
Figure 6:
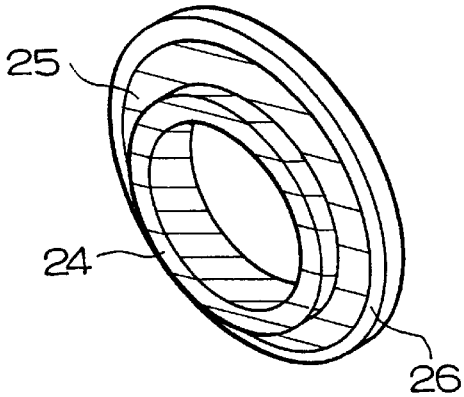
FIG. 6 is a similar perspective view of the masked electrodeposition object of FIG. 5 as viewed from the side opposite from the side on which the same object is viewed in FIG. 5.

After the electro-deposit has grown to a desired thickness, the electrodeposition object is taken out from the electrolyte bath, and the electrodeposition object 13 is melted away by using for instance, sodium hydroxide (the step of removing the electrodeposition object). Thus, a both coarse-sided electrodeposition blade 19 results as seen from FIG. 3. It has grindstone particles 12 projecting same height on its opposite surfaces.

Figure 7:
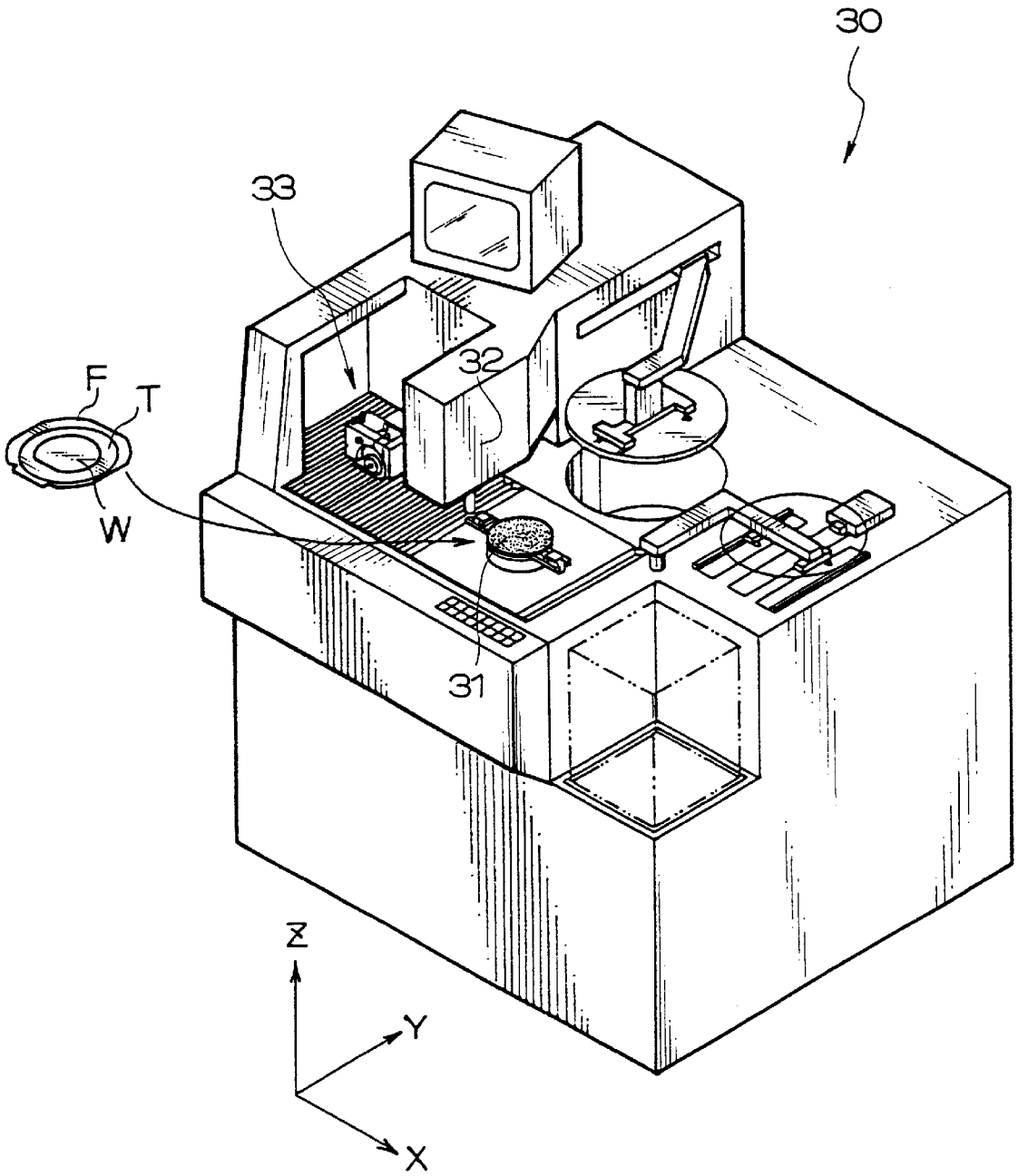
FIG. 7 illustrates a semiconductor wafer dicing apparatus having an electrodeposition blade attached to its cutting unit.
Figure 8:
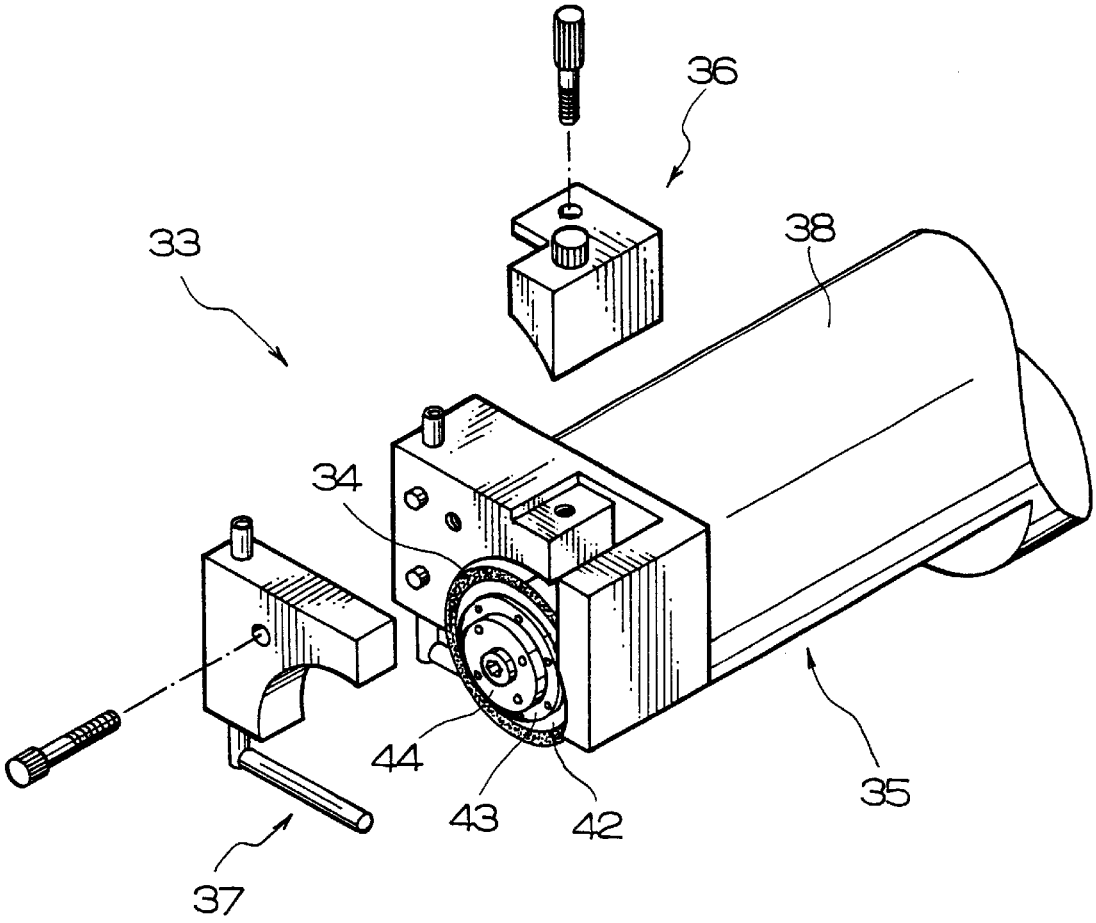
FIG. 8 is an exploded view of the cutting unit of the dicing apparatus.

The electrodeposition blade 19 thus made is attached to the cutting unit of the dicing apparatus 30 (see FIG. 7), and a semiconductor wafer W is diced with the both coarse-sided blade. The cutting surface conditions of the semiconductor wafer diced by rubbing the opposite blade surfaces against the workpiece are same in each pellet, and therefore, each pellet is guaranteed to be free of any distortion which, otherwise, would be caused by using a single coarse-sided electrodeposition blade. Thus, the precision with which a semiconductor wafer can be diced is increased, and accordingly the quality of pellets is improved.

Figure 10:
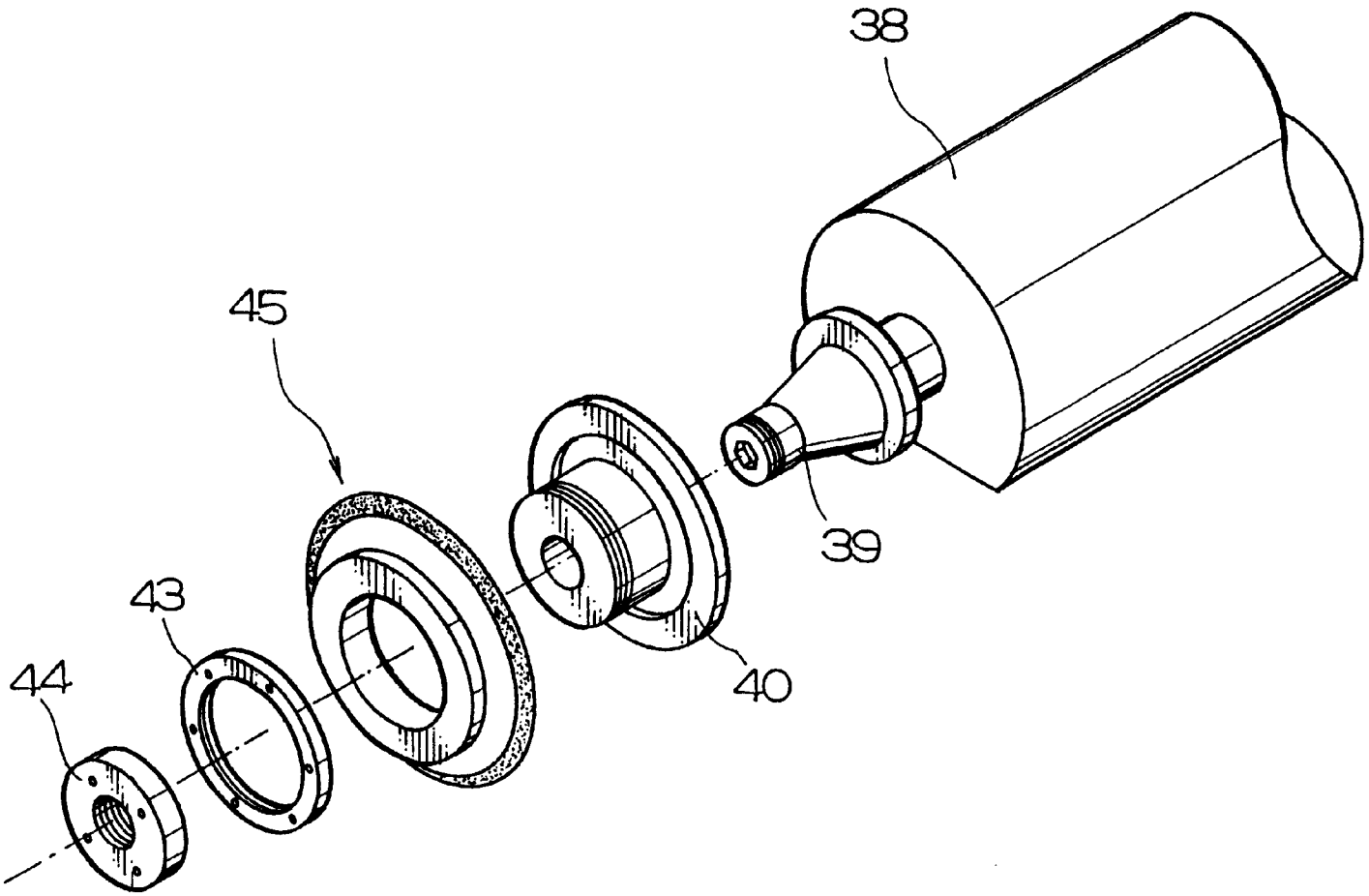
FIG. 10 is an exploded view of the spindle assembly of the cutting unit to which a hub-like electrodeposition blade is to be attached.
Figure 11:
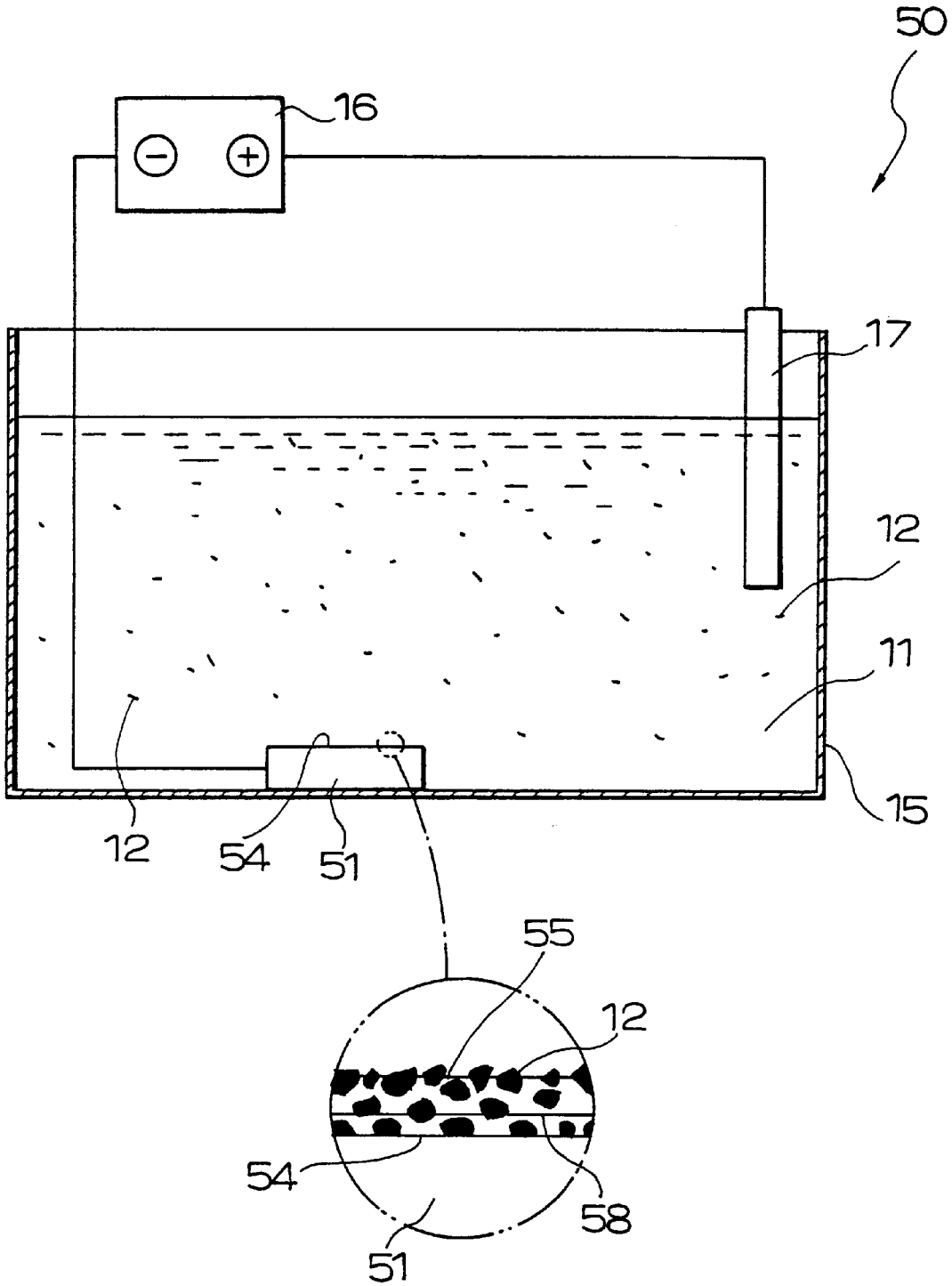
Figure 12:
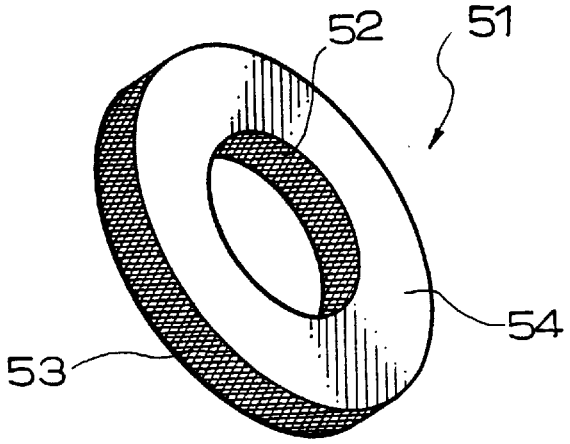
FIG. 12 PRIOR ART
FIG. 12 is a perspective view of an electrodeposition object to be used in making washer-like electrodeposition blades.
Figure 13:
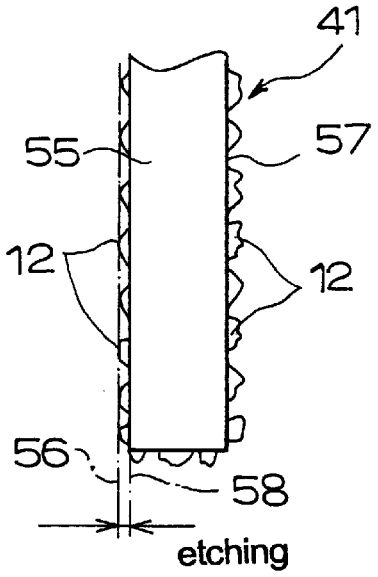
FIG. 13 PRIOR ART
FIG. 13 illustrates how an electrodeposition blade is like when made according to a conventional method.

As for a hub-like electrodeposition blade as shown in FIG. 10: an electrodeposition object 20 is treated so as to have minute irregularities formed thereon, and then the electrodeposition object 20 is covered selectively with masking material 23 to expose its outer circumference 22 only. The electrodeposition object thus masked is put on the bottom of the electrolytic cell 15 with its to be electro-deposited surface 21 up, thus allowing an electro-deposit to be formed thereon. After the electro-deposit has grown to a desired thickness, the electrodeposition object 20 is taken out from the electrolyte bath, and then, the electrodeposition object 20 is masked except for the hub 24 and the surrounding circumference on its rear side 25. Finally the so masked electrodeposition object 20 is melted away by using for instance, sodium hydroxide (the step of removing the electrodeposition object). Thus, a both coarse-sided electrodeposition blade 45 of the hub type results.

What is claimed is:

1. A method for making an electrodeposition blade using an apparatus for making an electrodeposition blade comprising at least an electrolyte bath containing an electrodeposition object and pulverized grindstone in the electrolyte bath, an electrolytic metal immersed in the electrolyte, and an electric source whose positive and negative terminals are connected to the electrolytic metal and electrodeposition object respectively, the method comprising at least the steps of:

forming minute irregularities on the surface of the electrodeposition object, on which a required electro-deposit is to be formed, thus providing a predetermined coarseness on the electrodeposition object;

immersing the electrodeposition object in the electrolyte bath to grow an electro-deposit on the surface of the electrodeposition object by making electric current to flow in the electrolyte bath; and taking the electrodeposition object having the electro-deposit formed on its surface away from the electrolyte bath to remove a selected part or the whole of the electrodeposition object, thus leaving the electro-deposit having both sides from which particles of the pulverized grindstone are projected.

2. A method for making an electrodeposition blade according to claim 1, wherein in the step of forming minute irregularities on the surface of the electrodeposition object, the minute irregularities are formed by:

scratching the surface with a sharp tool of a lathe machine by feeding the tool a controlled radial distance and by cutting a controlled depth;

sandblasting the surface; or chemically etching the surface, to provide a predetermined coarseness on the electrodeposition object.

3. A method for making an electrodeposition blade according to claim 2 wherein the coarseness of the valley-to-peak height of the irregularities is below the particle size of the pulverized grindstone.

4. A method for making an electrodeposition blade according to claim 3 wherein the valley-to-peak height of the irregularities is equal to 10 to 80% of the pulverized grindstone particle size.

5. A method for making an electrodeposition blade according to claim 4 wherein the pulverized grindstone has a particle size equal to 10 or more $\mu$m.

* * * * *